US009314125B2

(12) United States Patent
Anthony et al.

(10) Patent No.: US 9,314,125 B2
(45) Date of Patent: Apr. 19, 2016

(54) MANUALLY MOVABLE RAILS FOR COVERINGS FOR ARCHITECTURAL OPENINGS

(75) Inventors: James M. Anthony, Denver, CO (US); Kevin M. Dann, Englewood, CO (US); Joseph E. Kovach, Brighton, CO (US); Richard E. Rossi, Thornton, CO (US)

(73) Assignee: Hunter Douglas Inc., Pearl River, NY (US)

( * ) Notice: Subject to any disclaimer, the term of this patent is extended or adjusted under 35 U.S.C. 154(b) by 28 days.

(21) Appl. No.: 14/114,916

(22) PCT Filed: May 9, 2012

(86) PCT No.: PCT/US2012/037149

§ 371 (c)(1),
(2), (4) Date: Oct. 31, 2013

(87) PCT Pub. No.: WO2012/154871

PCT Pub. Date: Nov. 15, 2012

(65) Prior Publication Data

US 2014/0076504 A1 Mar. 20, 2014

Related U.S. Application Data

(60) Provisional application No. 61/484,021, filed on May 9, 2011.

(51) Int. Cl.
*E06B 3/48* (2006.01)
*A47H 5/032* (2006.01)
(Continued)

(52) U.S. Cl.
CPC ..... *A47H 5/032* (2013.01); *E06B 9/262* (2013.01); *E06B 9/322* (2013.01); *E06B 2009/2625* (2013.01); *E06B 2009/2627* (2013.01); *E06B 2009/3222* (2013.01)

(58) Field of Classification Search
CPC ..... E06B 9/322; E06B 2009/3222; E06B 2009/2625; E06B 2009/2627; E06B 9/262; E06B 9/324; E06B 9/325; E06B 2009/2441
USPC ..... 160/84.04, 84.05, 170
See application file for complete search history.

(56) References Cited

U.S. PATENT DOCUMENTS 4,733,711 A * 3/1988 Schon ..... 160/84.03
6,024,154 A 2/2000 Wang et al.
6,029,734 A 2/2000 Wang et al.
(Continued)

OTHER PUBLICATIONS

PCT International Search Report of related International Patent Application No. PCT/US2012/37149, dated Aug. 3, 2012, 4 pages.

*Primary Examiner* — Katherine Mitchell
*Assistant Examiner* — Johnnie A Shablack
(74) *Attorney, Agent, or Firm* — Dorsey & Whitney LLP

(57) ABSTRACT

An operating system for a retractable covering for an architectural opening having at least a movable bottom rail and possibly a movable middle rail connected to a shade material includes control or guide cords extending from a head-rail for the covering to the bottom rail and extending through the middle rail. Manually operable locks are provided on the bottom rail and the middle rail to grip the cords as they extend therethrough and a take-up system is provided in the bottom rail that is biased so as to retain the cords in a taut condition during movement of the bottom rail or the middle rail. The bottom and middle rails are moved manually simply by manually releasing the manual locks provided thereon so that exposed control cords are alleviated.

23 Claims, 13 Drawing Sheets

(51) Int. Cl.
*E06B 9/322* (2006.01)
*E06B 9/262* (2006.01)

(56) References Cited

U.S. PATENT DOCUMENTS

| | | | | |
|---|---|---|---|---|
| 6,644,372 | B2 | 11/2003 | Judkins | |
| 6,644,375 | B2 * | 11/2003 | Palmer | 160/170 |
| 6,675,861 | B2 * | 1/2004 | Palmer et al. | 160/170 |
| 6,684,930 | B2 * | 2/2004 | Palmer et al. | 160/170 |
| 6,823,925 | B2 * | 11/2004 | Militello et al. | 160/170 |
| 6,854,502 | B2 * | 2/2005 | Lai | 160/89 |
| 6,932,140 | B2 * | 8/2005 | Ni | 160/172 R |
| 7,028,737 | B2 * | 4/2006 | Hsu | 160/84.03 |
| 7,093,644 | B2 * | 8/2006 | Strand | 160/170 |
| 7,096,917 | B2 * | 8/2006 | Ciuca et al. | 160/170 |
| 7,117,919 | B2 * | 10/2006 | Judkins | 160/170 |
| 7,168,476 | B2 * | 1/2007 | Chen | 160/170 |
| 7,311,134 | B2 * | 12/2007 | Cheng | 160/173 R |
| 7,320,354 | B2 * | 1/2008 | Cheng | 160/170 |
| 7,331,370 | B1 * | 2/2008 | Militello et al. | 160/170 |
| 7,373,965 | B2 * | 5/2008 | Cheng | 160/178.2 |
| 7,406,995 | B2 * | 8/2008 | Huang | 160/170 |
| 7,575,036 | B2 * | 8/2009 | Cheng | 160/170 |
| 7,793,700 | B2 | 9/2010 | Bossler | |
| 7,819,166 | B2 * | 10/2010 | Militello et al. | 160/84.04 |
| 8,573,281 | B2 * | 11/2013 | Drew et al. | 160/84.05 |
| 8,794,296 | B2 * | 8/2014 | Shih et al. | 160/168.1 R |
| 8,857,494 | B2 * | 10/2014 | Kirby et al. | 160/84.04 |
| 8,887,786 | B2 * | 11/2014 | Anderson et al. | 160/84.03 |
| 8,944,135 | B2 * | 2/2015 | Spray | 160/168.1 R |
| 2002/0088562 | A1 * | 7/2002 | Palmer | 160/170 |
| 2004/0177933 | A1 * | 9/2004 | Hillman et al. | 160/170 |
| 2005/0205219 | A1 * | 9/2005 | Hsu | 160/170 |
| 2006/0048904 | A1 * | 3/2006 | Gruner | 160/84.05 |
| 2006/0175020 | A1 * | 8/2006 | Cheng | 160/84.04 |
| 2006/0196612 | A1 | 9/2006 | Strand et al. | |
| 2006/0201637 | A1 * | 9/2006 | Nien | 160/170 |
| 2007/0023151 | A1 * | 2/2007 | Judkins | 160/170 |
| 2007/0107854 | A1 * | 5/2007 | Jelic | 160/170 |
| 2007/0151676 | A1 * | 7/2007 | Lin | 160/170 |
| 2007/0193703 | A1 * | 8/2007 | Cheng | 160/173 R |
| 2008/0000592 | A1 * | 1/2008 | Huang | 160/170 |
| 2008/0093033 | A1 * | 4/2008 | Hsu et al. | 160/169 |
| 2008/0099159 | A1 * | 5/2008 | Nien | 160/170 |
| 2008/0277076 | A1 * | 11/2008 | Cheng | 160/167 R |
| 2009/0014133 | A1 * | 1/2009 | Lin | 160/181 |
| 2010/0206492 | A1 * | 8/2010 | Shevick | 160/170 |
| 2011/0005690 | A1 * | 1/2011 | Harding | 160/84.03 |
| 2012/0227912 | A1 * | 9/2012 | Anderson et al. | 160/87 |
| 2012/0312486 | A1 * | 12/2012 | Spray | 160/340 |
| 2013/0032300 | A1 * | 2/2013 | Yu et al. | 160/84.02 |
| 2013/0087296 | A1 * | 4/2013 | Mullet et al. | 160/340 |
| 2013/0299103 | A1 * | 11/2013 | Anderson et al. | 160/331 |
| 2014/0048220 | A1 * | 2/2014 | Cheng | 160/368.1 |
| 2014/0158314 | A1 * | 6/2014 | Anderson et al. | 160/368.1 |
| 2015/0020980 | A1 * | 1/2015 | Franssen | 160/84.01 |
| 2015/0020982 | A1 * | 1/2015 | Anderson et al. | 160/298 |
| 2015/0075729 | A1 * | 3/2015 | Anderson et al. | 160/193 |

* cited by examiner

MANUALLY MOVABLE RAILS FOR COVERINGS FOR ARCHITECTURAL OPENINGS

CROSS-REFERENCE TO RELATED APPLICATIONS

The present application is the national stage application of International Patent Application No. PCT/US2012/037149, filed May 9, 2012, and entitled "Manually Movable Rails For Coverings For Architectural Openings," which claims priority pursuant to 35 U.S.C. §119(e) to U.S. provisional application no. 61/484,021, filed May, 9, 2011, and entitled "Manually Movable Rails for Coverings for Architectural Openings," which are hereby incorporated herein by reference in their entireties.

FIELD

The present disclosure relates generally to retractable coverings for architectural openings and more particularly to a retractable covering wherein one or more rails supporting a flexible shade material for the covering is movable between selected positions by a manually operable lock system on the rail.

DESCRIPTION OF THE RELEVANT ART

Retractable coverings for architectural openings have assumed many forms over a considerable period of time. While such coverings come in numerous forms, typically they include a headrail that is suspendable across the top of an architectural opening with the headrail operatively suspending therefrom a collapsible shade material with the bottom edge having a bottom rail secured thereto. The bottom rail is typically moved toward or away from the headrail to collapse or extend the shade material with movement of the bottom rail typically being manipulated by lift cords which extend from the headrail to the bottom rail adjacent to or through the shade material. The ends of the lift cords are accessible to an operator so that pulling on the ends of the lift cords causes the bottom rail to elevate and raising the ends causes the bottom rail to lower in moving the shade material between the collapsed or retracted position and the extended position.

SUMMARY

The present disclosure has been developed to provide a new operating system for retractable coverings where either the bottom rail is movable or the bottom rail and a middle rail are movable in moving the covering between extended and retracted positions within the architectural opening. The system has been designed so that lift cords, which are manipulated by an operator, are not necessary.

Pursuant to the present disclosure, a retractable covering for an architectural opening has at least a bottom rail that is movable toward and away from a headrail with the bottom rail being secured or otherwise operably connected to the lower edge of a collapsible shade material. The bottom rail is operably connected to a guide cord system confined within the covering while extending from the headrail to the bottom rail. A manually operable lock member is disposed in the bottom rail so that an operator can manually manipulate the lock member to release the grip of the lock on the operating cord to allow the bottom rail to be raised or lowered through pressure by the operator on the bottom rail. When the operator manually releases the lock, it re-activates and grips the operating cord to hold the bottom rail in a preselected position.

A movable middle rail may also be used in the system pursuant to the present disclosure with the middle rail being secured to the top edge of the shade material and also being operatively connected to the operating cord system with a second manually operable lock member so that the middle rail, as the bottom rail, can be raised or lowered by manually releasing the lock member to remove its locking engagement with the operating cord in order to move the rail upwardly or downwardly with manual pressure. When the rail is manually desirably positioned by an operator, the second lock member is released and automatically re-grips the operating cords to retain the middle rail in the preselected position.

As will be appreciated, the rails can be manually moved and selectively positioned without exposed operating cords which could present child safety concerns, and without a counter-balance system which can complicate an operating system.

Other aspects, features and details of the present disclosure can be more completely understood by reference to the following detailed description of a preferred embodiment, taken in conjunction with the drawings and from the appended claims.

DETAILED DESCRIPTION

Figure 1:
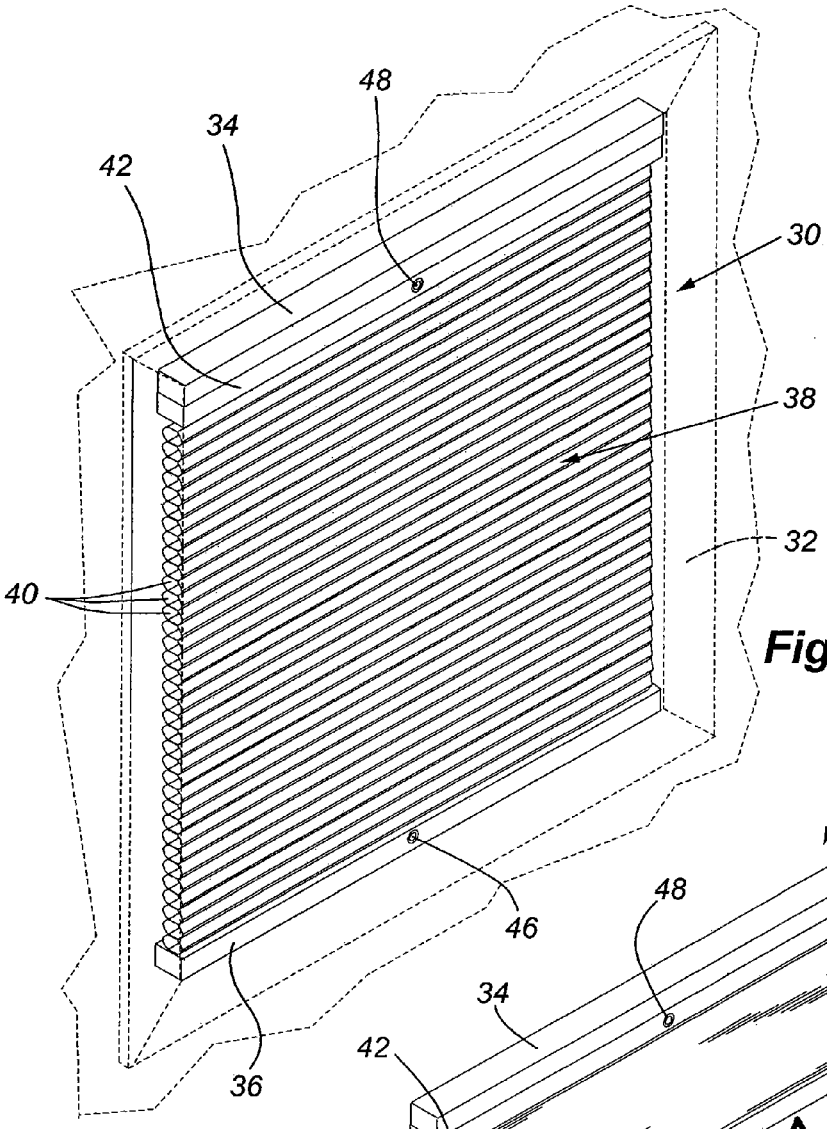
FIG. 1 is an isometric of a covering for an architectural opening in accordance with the present disclosure shown in an extended position within an architectural opening shown in dashed lines.

With reference initially to FIGS. 1-4, the covering 30 pursuant to the present disclosure is shown in various operative positions. In FIG. 1, the covering is shown disposed within an architectural opening. The architectural opening may incorporate a frame 32, illustrated in dashed lines, that surrounds the opening and within which the covering 30 is disposed.

Figure 7:
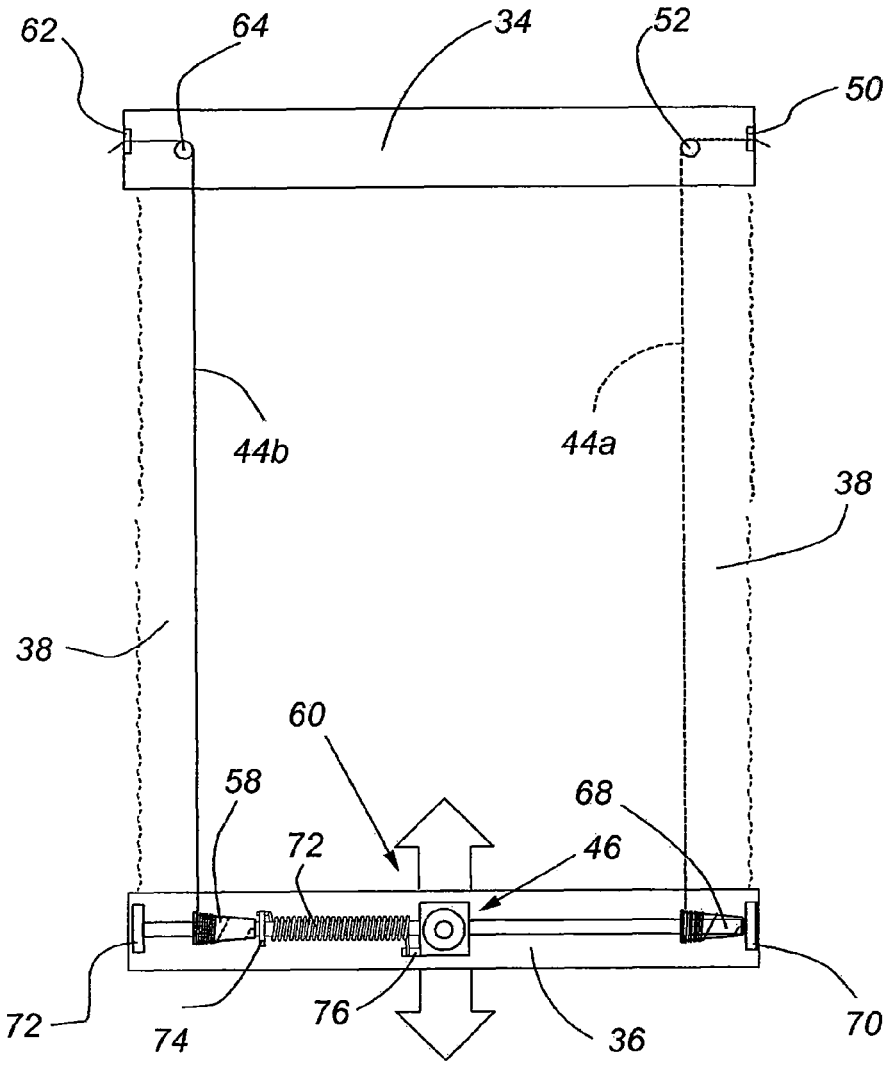
FIG. 7 is a diagrammatic front elevation of an embodiment of the disclosure without a movable middle rail.

The covering 30 pursuant to the disclosure is illustrated as a top down/bottom up covering, even though it will be appreciated by reference to FIG. 7 and with the description that follows that a bottom up covering could also be implemented wherein a middle rail for the covering would be eliminated.

With reference to FIGS. 1-4, the covering 30 can be seen to include a headrail 34 which is operably connected at the top of the architectural opening, a bottom rail 36 operably connected along a bottom edge of a collapsible shade material 38 shown for illustrative purposes as a cellular shade material that includes a plurality of horizontally disposed transversely collapsible and interconnected cells 40. The top edge of the shade material is operably connected to a middle rail 42 which is movable similarly to but independently of the bottom rail so that the covering can be moved between the various positions illustrated as well as others.

Figure 2:
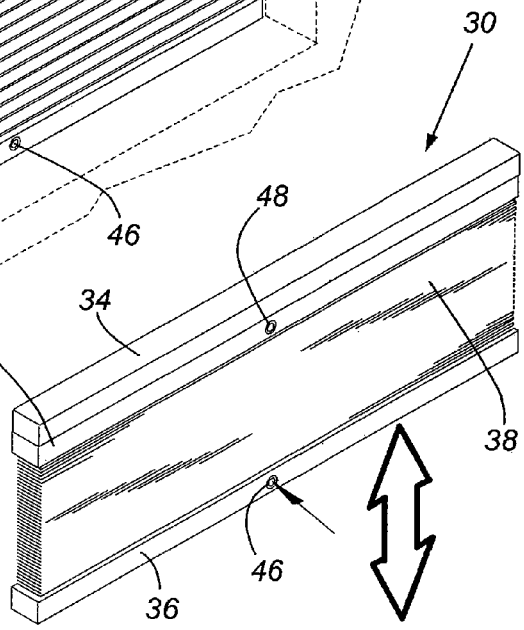
FIG. 2 is an isometric of the covering shown in FIG. 1 in a retracted position.
Figure 3:
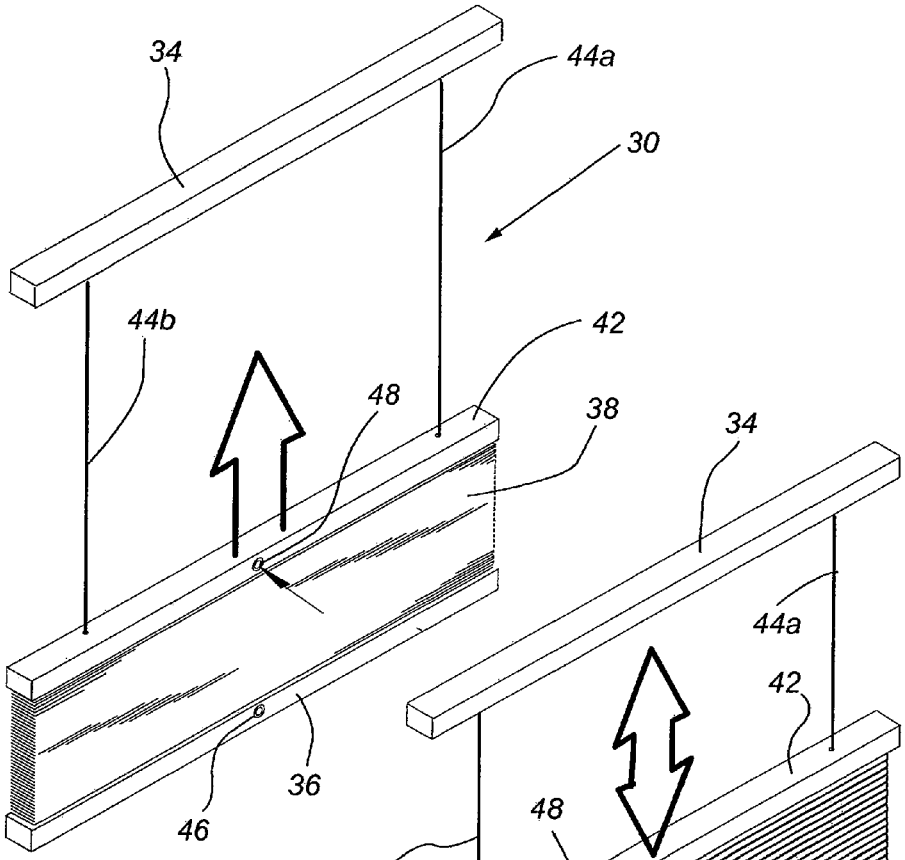
FIG. 3 is an isometric similar to FIG. 2 with the top of the covering having been lowered.
Figure 4:
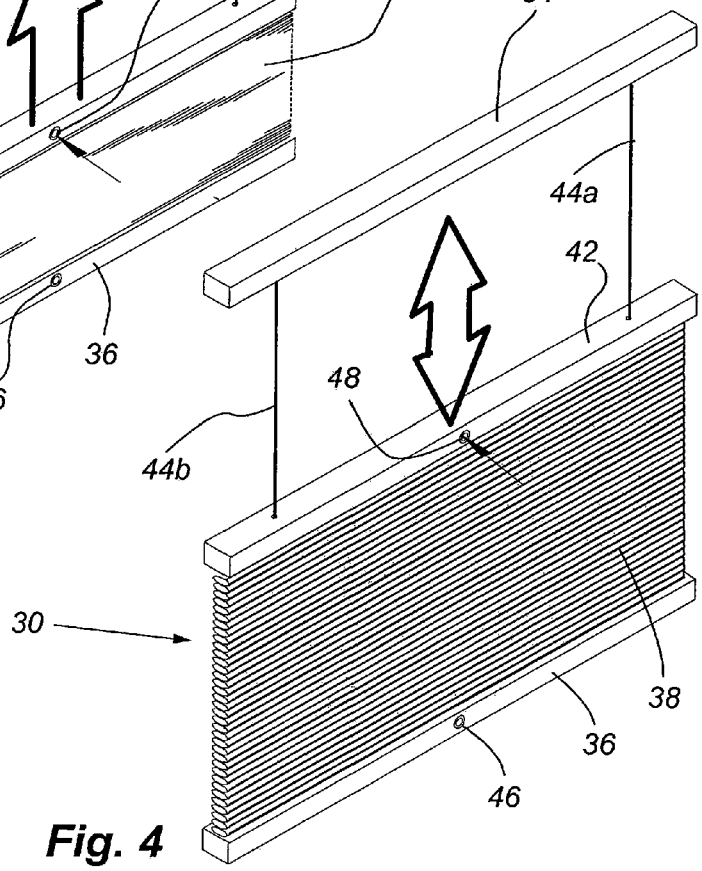
FIG. 4 is an isometric similar to FIG. 3 with the top edge of the shade material having been partially raised relative to its position in FIG. 3.

Referencing FIG. 1, the covering 30 is shown in a fully extended position across the opening with the bottom rail 36 adjacent the bottom edge of the architectural opening and the middle rail 42 engaged with the headrail 34. FIG. 2 shows the bottom rail having been raised so that the shade material 38 is fully collapsed between the bottom rail and the middle rail while the middle rail has remained engaged with the headrail. FIG. 3 shows the bottom rail fully extended as in FIG. 1 but wherein the middle rail has been fully lowered so that the shade material is fully collapsed or retracted between the middle rail and the bottom rail. FIG. 4 shows the middle rail having been elevated from its position in FIG. 3 so that the shade material is partially extended from a fully extended bottom rail and a partially extended middle rail. It will be appreciated from the above that the shade material can be extended or retracted to any desired degree and positioned at any location within the architectural opening.

As will be described in more detail hereafter, a control system for the covering is adapted to hold the bottom rail 36, as well as the middle rail 42 when applicable, in any desired position within the architectural opening. The control system incorporates two separate guide cords 44*a* and 44*b*, which are operably connected at an upper end in a fixed relationship with an associated end of the headrail 34 and operably connected at a lower end within the bottom rail and so that the lower end of the operating cords can be gathered within the bottom rail depending upon the positioning of the bottom rail relative to the headrail. Between the headrail and the bottom rail, the cords 44*a* and 44*b* criss-cross through the middle rail so as to pass from one side of the covering to the other or may not criss-cross at all as seen in FIG. 7 and be attached at associated ends to the headrail if a middle rail was not used.

At a generally centered location within the bottom rail 36, a first manually operable lock member or system 46 is provided which is designed to selectively permit or prohibit movement of the bottom rail relative to the headrail 34 by allowing the operating cords 44*a* and 44*b* to be gathered in or released from the bottom rail. A second manually operable lock member or system 48 is positioned within the middle rail 42 with the operating or guide cords extending therethrough so that the middle rail can be raised or lowered by operating the second manually operable lock member.

Figure 5:
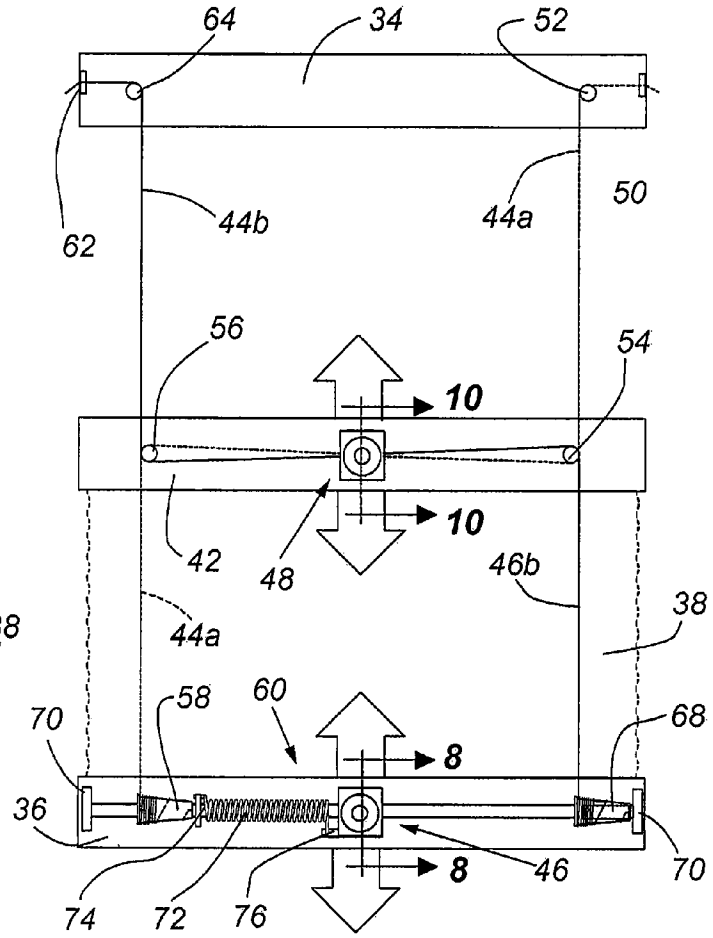
FIG. 5 is a diagrammatic front elevation of a covering in accordance with a first embodiment of the present disclosure with the embodiment being a top down/bottom up covering and with the middle rail centered within the architectural opening.

With reference to FIG. 5, a diagrammatic representation of a first operating system in accordance with the present disclosure is shown. It can there be seen that there are first 44*a* and second 44*b* operating or guide cords used in the system with the first cord being shown in dashed lines and the second cord in solid lines for distinguishing purposes only. In reality, the cords may be identical in structure while being flexible but longitudinally non-extensible. However, in other embodiments, the cords 44*a*, 44*b* may be different from one another. The top end of the first cord 44*a* is anchored at 50 within the headrail 34 at the right end of the headrail and passes around a first pulley 52 before extending downwardly adjacent to or through the shade material 38 and into the right end of the middle rail 42 where it passes around a second pulley 54 and then traverses the middle rail to a third pulley 56 adjacent to the left end of the middle rail and after passing around the third pulley it extends downwardly adjacent to or through the shade material and is anchored to a left or first take-up spool 58 in a cord take-up system 60 to be described hereafter. The second cord 44*b* has its upper end secured at 62 at a left end of the headrail and passes around a fourth pulley 64 before extending downwardly adjacent to or through the shade material and then around a second grooved surface (not seen) around the third pulley 56 so that it can extend longitudinally across the middle rail and around a second groove (not seen) around the second pulley 54 before extending downwardly adjacent to or through the shade material to a right or second take-up spool 66 in the cord take-up system 60 within the bottom rail.

The cord take-up system 60 has a transversely extending reversibly rotatable shaft 68 that is journaled in bearings 70 at opposite ends of the bottom rail 36 with the first take-up spool 58 being positioned adjacent to the left end of the shaft and the second take-up spool 66 to the right end of the shaft. The first and second take-up spools are keyed to the shaft so as to rotate in unison therewith about the longitudinal axis of the shaft. A coil spring 72 circumscribes the shaft to bias the shaft in a direction which would cause the cords 44*a* and 44*b* to wrap about their associated take-up spools. The coil spring has a tang at one end engaged with an anchor washer 74 secured to the shaft for rotation therewith and has a tang at the opposite end abutted to a fixed pin 76 in the bottom rail so that when the shaft is rotated in a direction corresponding to a lowering of the bottom rail, the spring is tensioned. The cord take-up system is pre-arranged so the bottom rail is always biased upwardly.

The first manually operable lock system 46 is mounted in the bottom rail 36 as probably most fully appreciated by reference to FIGS. 5, 7, 8 and 9. The manually operable lock system in the bottom rail of the embodiment of FIG. 5 has a housing 78 positioned within the bottom rail so as to be slidable along the length of the bottom rail with a raised slide 80 shown best in FIGS. 8 and 9. The slide of the lock member housing is guided within a channel 82 defined on the under surface of the top wall 84 of the bottom rail with a similar channel 85 being provided on the top surface of the top wall 84 to anchor the lower edge of the shade material 38 (not shown). A push button slide member 86, which is preferably non-circular in cross-section has an enlarged body 88 at its center with a first cylindrical hub 90 on an inner end and a second cylindrical hub or push button 92 on its opposite or outer end. The second hub projects outwardly through a circular opening 44 in the face or front wall 96 of the bottom rail so as to be accessible by an operator of the covering and to hold the lock system 46 in place within the bottom rail. The first hub seats one end of a compression spring 98 whose opposite end is engaged with a rear wall 100 of a cavity 102 within which the slide member is slidably disposed. The compression spring therefore biases the slide member to the right as viewed in FIGS. 8 and 9 or toward the front of the bottom rail so that the second hub is disposed for engagement by the thumb or other fingers of an operator's hand.

Figure 8:
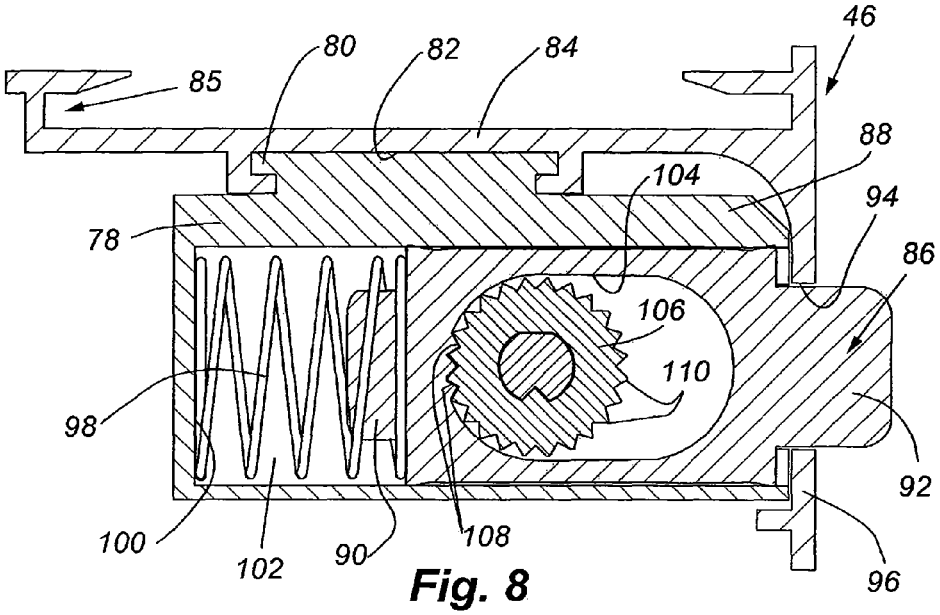
FIG. 8 is a section along line 8-8 of FIG. 5 showing the lock element in a neutral locked position.
Figure 9:
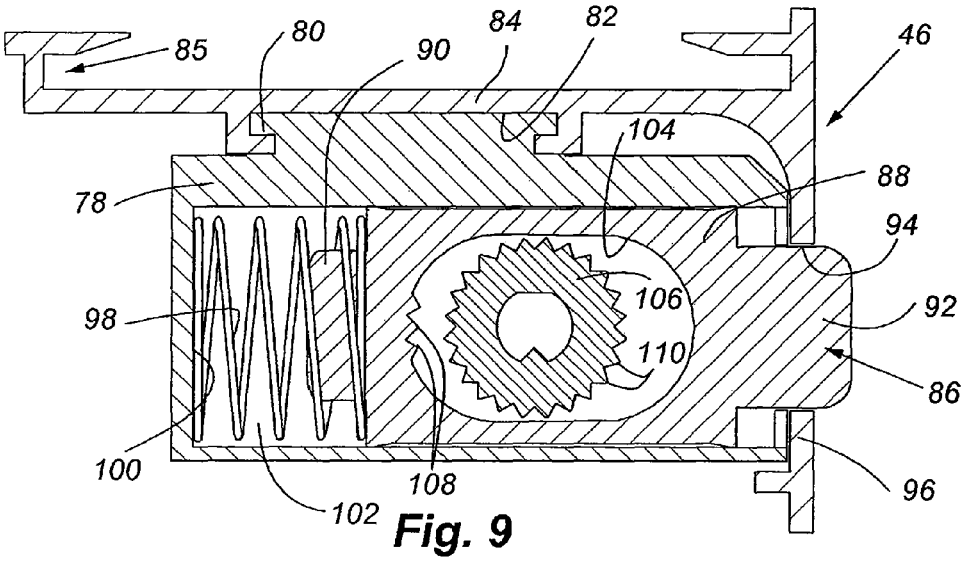
FIG. 9 is a section similar to FIG. 8 showing the lock element in a depressed unlocked position.

The slide member 86 has an ovular horizontally oriented transverse passage 104 therethrough which extends in the direction of the length of the bottom rail 36 and receives the rotatable shaft 68 which has a gear 106 keyed thereto within the ovular passage as seen in FIGS. 8 and 9. The slide member has engaging teeth 108 or another engagement member formed at the inner end of the ovular passage with the teeth in the slide being adapted to releasably engage the teeth 110 on the gear to selectively permit or prohibit rotation of the gear and consequently the shaft within the bottom rail. As can be appreciated with reference to FIG. 8, when the lock member 46 is in its neutral fully locked or engaged position as when the push button is fully extended out the front wall of the bottom rail, the teeth 110 on the gear are engaged with the teeth 108 on the slide member to prevent rotation of the gear and consequently the shaft, but upon depression of the slide member or push button, as shown in FIG. 9, the slide member moves inwardly against the bias of the compression spring 98 disengaging the teeth on the gear from the teeth on the slide member so that the shaft is free to rotate either under the bias of the coil spring 72 around the shaft or in a direction caused by lowering of the bottom rail manually.

In other words, as will be appreciated, when it is desired to move the bottom rail 36 from any location within the architectural opening, an operator simply depresses the push button 92 which releases the manual lock 46 and allows the shaft 68 to rotate in one direction or another depending upon the direction of movement of the bottom rail by the operator. In other words when the button has been depressed, the bottom rail can be manually raised or lowered as desired by pressure applied by an operator. If it is desired to lower the bottom rail, the button is merely depressed and the bottom rail is pulled downwardly against the bias of the coil spring 72 with the guide cords 44*a* and 44*b* unwrapping from their associated spools 58 and 66, respectively, and when the bottom rail has been positioned at its desired spacing from the headrail 34, the push button is released thereby locking the gear 106 and the associated shaft 68 in a position which maintains each of the operating or guide cords in a taut condition. When it is desired to raise the bottom rail, the push button 92 is again depressed and the bottom rail is manually raised but as the rail is raised, the bias applied to the shaft by the coil spring 72 causes the shaft to rotate in a direction to wrap the operating or guide cords about their associated spools while maintaining a taut condition of each of the cords. When the bottom rail is positioned as desired, the push button is merely released thereby locking the shaft and allowing the bottom rail to remain in a fixed position within the architectural opening.

The operating or guide cords 44*a* and 44*b* extend vertically either adjacent to the shade material 38 or through vertically aligned openings (not seen) provided therein, and generally the guide cords 44*a* and 44*b* remain taut all through the operation of the take-up system so that the bottom rail 36 as well as the middle rail 42 can be moved easily and smoothly between desirable spacings from the headrail 34 and retain a horizontal orientation.

The second manual lock system 48, as mentioned previously, is mounted in the middle rail and is probably best appreciated by reference to FIGS. 10-14. This manually operable lock also has a housing so that it is slidably positioned along the length of the middle rail. Again, a push button slide member is slidably disposed within a cavity in the housing as will be described in more detail hereafter with the slide member having a first hub that seats one end of a compression spring within the cavity and a second hub defining a push button for depression by an operator.

Figure 10:
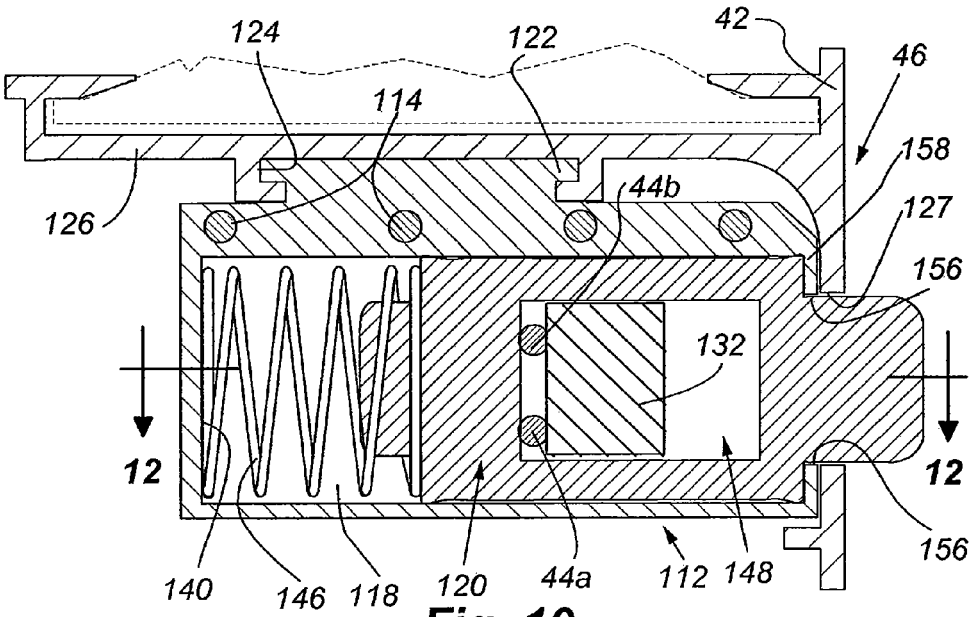
FIG. 10 is a section taken along line 10-10 of FIG. 5 with the lock member in a neutral locked position.
Figure 11:
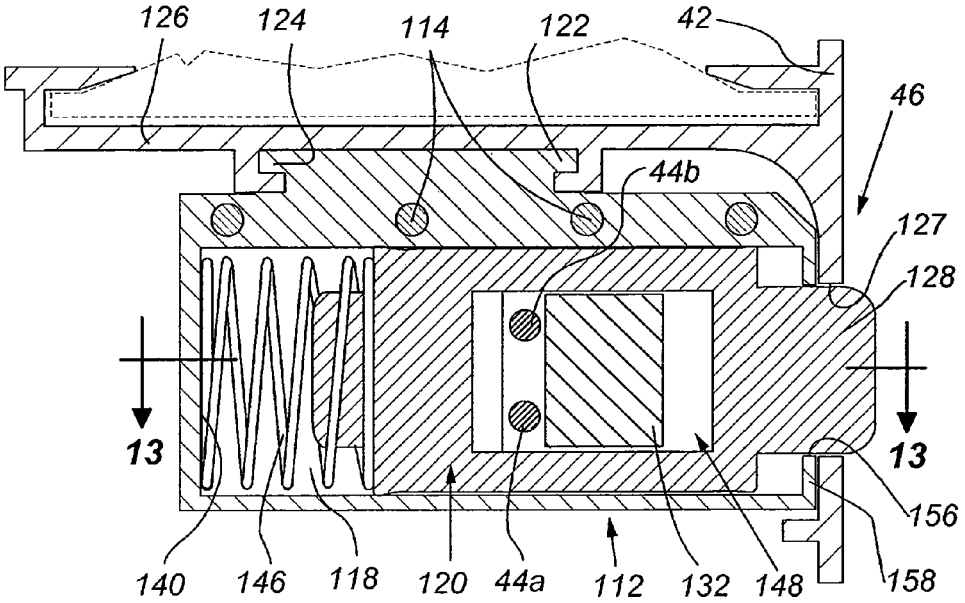
FIG. 11 is a section similar to FIG. 10 showing the lock member in a depressed unlocked position.
Figure 14:
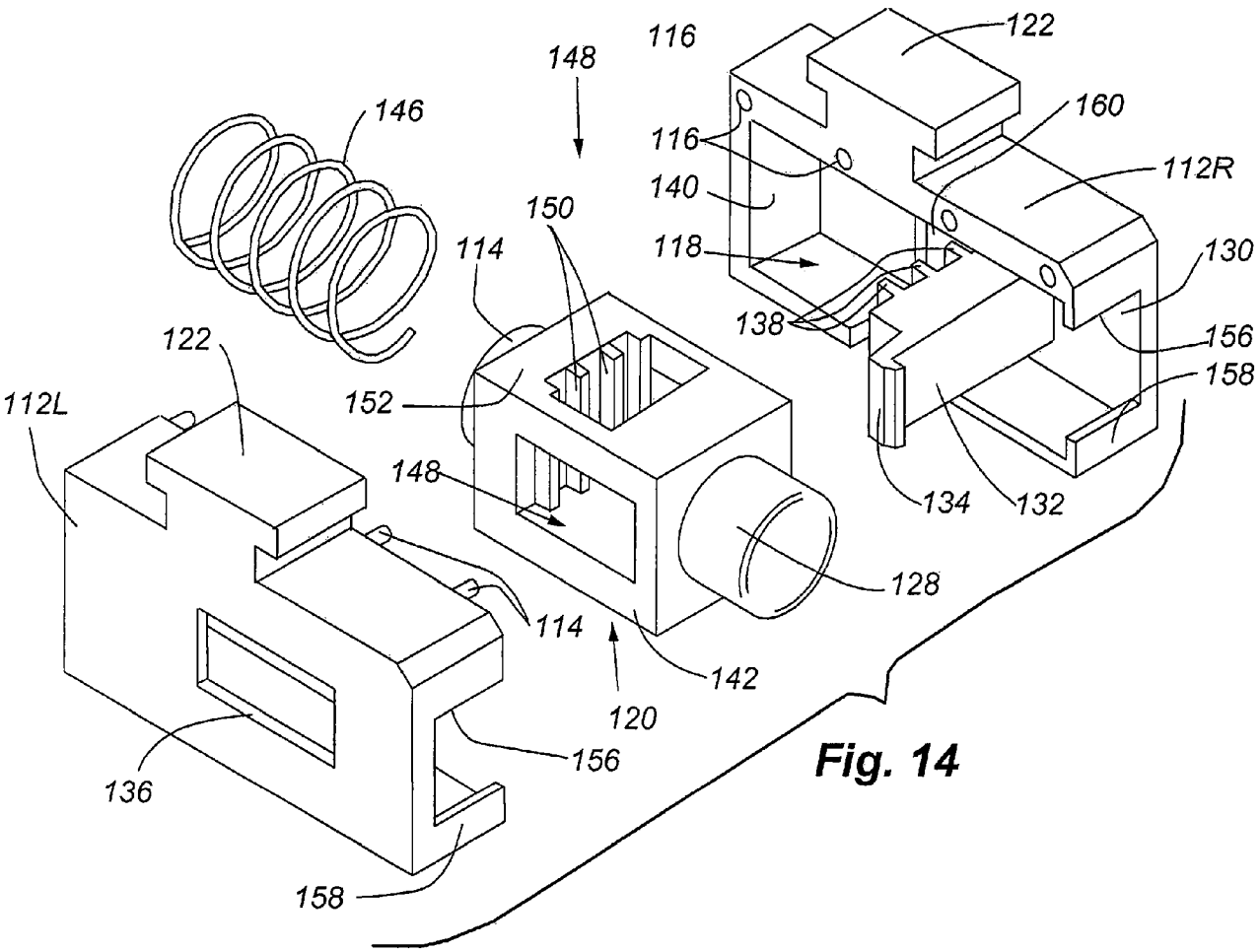
FIG. 14 is an exploded isometric of the lock member shown in FIGS. 10-13.

The second manual lock system 48 includes a two-piece housing 112 having a left half 112L and a right half 112R, as viewed in FIG. 14. The left and right halves, when connected together with guide pins 114 in aligned recesses 116 in the halves of the housing, define a lower cavity 118 in which a slide member 120 of quadrangular transverse cross-section is slidably positioned. The top of the integrated housing includes a horizontal slide plate 122 adapted to slidably mate with a groove 124 in the undersurface of the top wall 126 of the middle rail 42, as best seen in FIGS. 10 and 11. In this manner, the housing 112 can be positioned along the length of the middle rail, as is the case with the first manual lock in the bottom rail, by sliding the housing along the length of the middle rail to the desired location which might typically be the longitudinal center of the middle rail where a hole 127 is provided in the front wall of the middle rail for receiving a push button 128 of the slide member 120.

Figure 12:
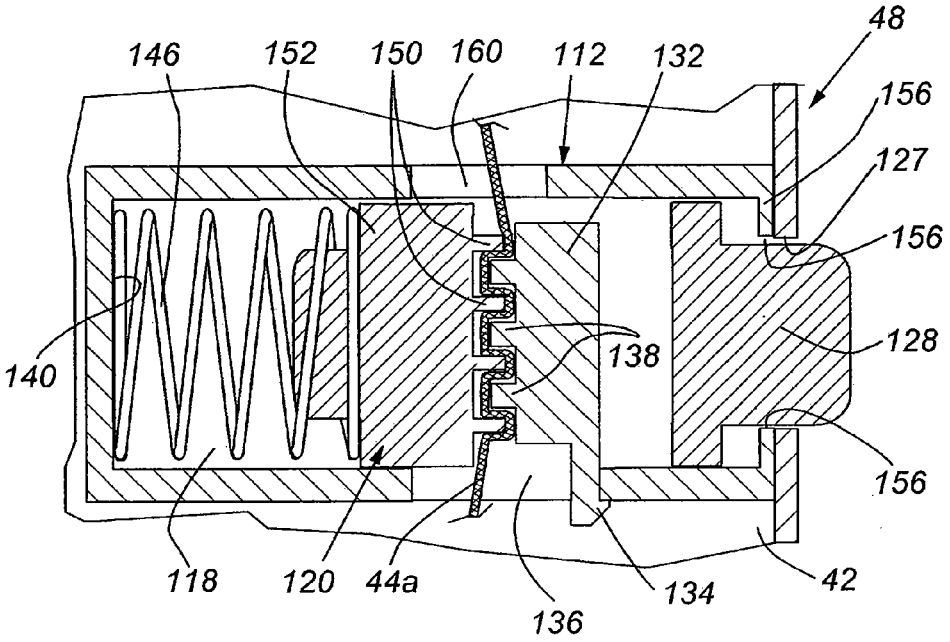
FIG. 12 is a section taken along line 12-12 of FIG. 10.
Figure 13:
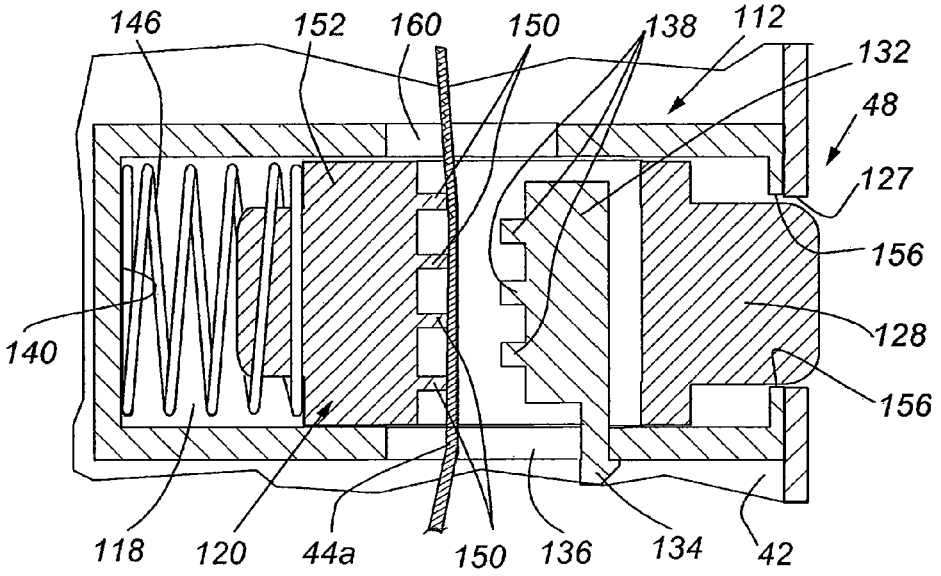
FIG. 13 is a section taken along line 13-13 of FIG. 11.

As seen in FIG. 14, the right side 112R of the housing 112 has a right side wall 130 and an integral inwardly extending fixed block 132 which has a catch 134 on its free end adapted to be received and releasably connected in a hole 136 through left half 112L of the housing as can be appreciated by reference to FIGS. 12 and 13. Vertically formed on the fixed block are a plurality of spaced vertically extending fingers 138 or engagement members which project toward a rear wall 140 of the housing 112.

The slide member 120 has a hollow block like main body 142 with a first hub 144 on its inner or rear end adapted to receive one end of a compression spring 146, and the push button 128 or second hub on its front or outer end which is manually engageable by an operator of the system. The block like main body has a transverse passage 148 extending therethrough from left to right which is adapted to slidably receive the fixed block 132 of the housing 112 and facing inwardly toward the open cavity defined by the transverse passage are a plurality of fixed vertically extending fingers 150 on an inner surface of the inner or rear wall 152 of the slide member 120 with these fingers confronting in offset relationship the fingers 138 on the fixed block 132 of the housing. Vertical channels or grooves are defined between the fingers 138 on the fixed block and the fingers 150 on the slide member with the fingers on the fixed block being aligned with the channels on the slide member, and the fingers on the slide member being aligned with the channels on the fixed block. When the housing is assembled with the slide member in the lower cavity 118 defined therein, the compression spring 146 engages the rear wall 140 of the housing as well as the rear wall 152 of the slide member so as to bias the slide member forwardly. The second hub or push button 92 extends through a hole 156 in the front wall 158 of the housing as well as through the opening 126 in the front wall of the middle rail 42 so as to be exposed for manual depression by an operator. The second lock member 48 is in a neutral position when the button 128 fully extends forwardly out of the middle rail under the bias of the compression spring, and in this position, the fingers on the fixed block and the slide member are interdigitated.

The operating or guide cords 44*a* and 44*b*, as mentioned previously, criss-cross along the length of the middle rail 42 and in doing so extend through an opening 160 through the right wall 130 and the hole 136 through the left side wall of the housing and through the transverse passage 148 through the slide member 120. They also extend across the fingers on the fixed block 132 and the slide member, so that when the fingers are interdigitated, as seen in FIG. 12, the cords are gripped by the interdigitated fingers in the neutral position of the block. When the slide member is depressed, however, by applying pressure to the push button 128, the fingers become separated as seen in FIG. 13 so that there is space for the guide cords to slide therethrough and the lock 48 is disposed thereby in an unlocked or released position so that the middle rail can be raised or lowered which requires sliding movement of the cords through the lock.

As mentioned previously, the lock member 48 can be positioned along the length of the middle rail 42 by sliding it along the rail, and as will be appreciated, the push button 128 can be depressed while sliding along the length of the middle rail until the push button pops out of the hole in the front wall of the middle rail when they become aligned and at that position the lock is desirably positioned in place within the middle rail.

In operation, to raise or lower the middle rail 42, which raises or lowers the top edge of the shade material 38, the push button 128 on the middle rail is simply depressed with an operator's thumb or finger while the rail itself is gripped so that it can be raised or lowered with manual pressure and then when desirably positioned, the push button is released causing the second manual lock 48 to engage or grip the cords to hold the middle rail in the selected position.

Figure 6:
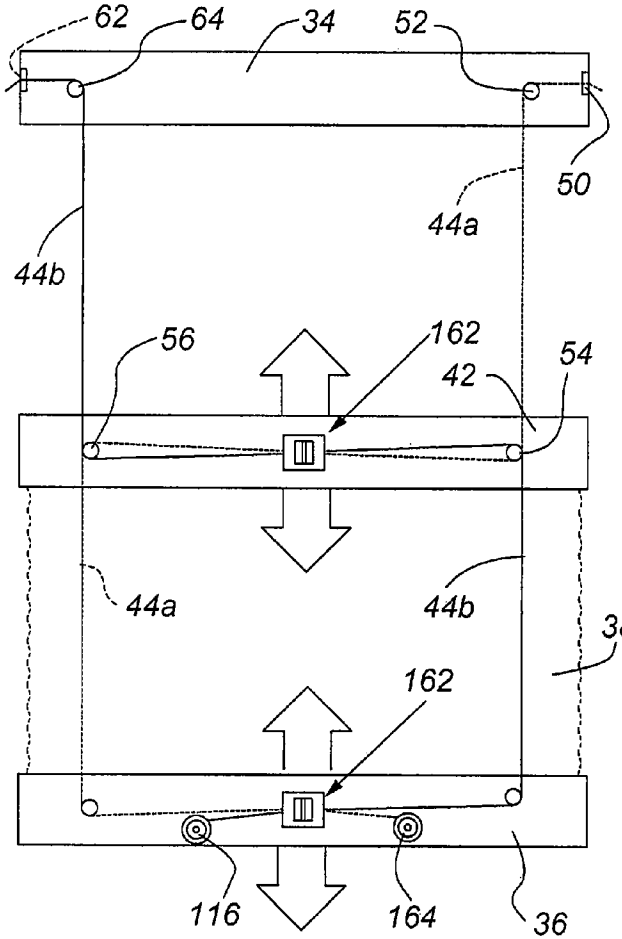
FIG. 6 is a diagrammatic front elevation similar to FIG. 5 showing a second embodiment of the present disclosure.

In a second embodiment of the operating system of the present disclosure, shown in FIG. 6, the push button systems of the embodiment of FIG. 5 is replaced with manual slide lock members 162 with the manual slide lock in the bottom rail 36 being generally identical to that in the middle rail 42. In this embodiment, rather than having the transverse rotating shaft 68, illustrated in the embodiment of FIG. 5, the lower end of the first operating or guide cord 44*a* is anchored to a first coil spring biased spool 164 to the right of the slide lock 162 as seen in FIG. 6, and the second operating or guide cord 44*b* is anchored to a second coil spring biased spool 166 positioned to the left of the slide lock. The first and second operating or guide cords extend through the slide lock in the bottom rail so as to be selectively gripped or released as will be described hereafter. Each of the coil spring biased spools is rotatable about a horizontal axis extending transversely of the bottom rail and has a coil spring 168 as a part thereof which biases the spool toward a wrapped condition of the associated cord about the spool. In other words, when the bottom rail is moved up so the operating or guide cords are gathered within the bottom rail, they are wrapped about the spool under the bias of the coil springs on the spools. When the bottom rail is moved downwardly, the guide cords are unwrapped from their associated spools rotating the spools in a direction which increases the tension in the coil springs.

Figure 15:
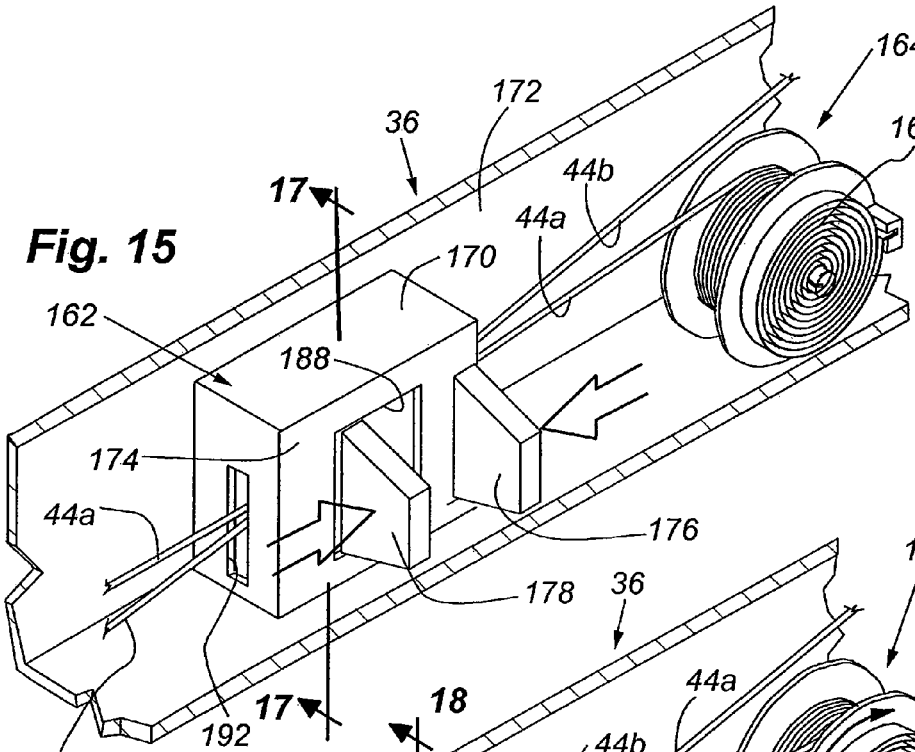
FIG. 15 is a fragmentary isometric showing the lock member in the bottom rail of the system of FIG. 6 in a neutral locked position.
Figure 16:
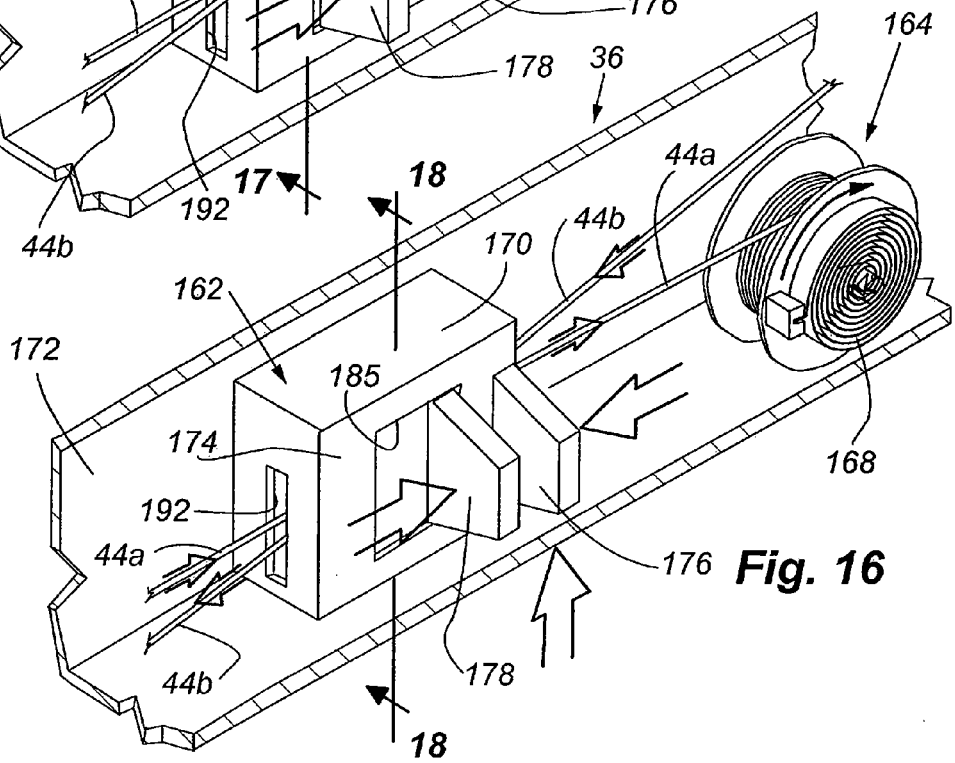
FIG. 16 is an isometric similar to FIG. 15 with the lock member in a depressed unlocked position.

Referring to FIGS. 15-21, the slide lock 162 in the bottom rail 36 is illustrated, even though, as mentioned previously, the same slide lock is used in the middle rail as well. As will be described in detail hereafter, the slide lock is possibly best seen in general in FIGS. 15 and 16 where it can be seen to include an outer housing 170 that is snap locked onto the rear wall 172 of the bottom rail 36 with the first 44*a* and second 44*b* guide cords criss-crossing therethrough. The outer face 174 of the housing has a fixed finger 176 projecting forwardly through an opening (not shown) in the front wall of the bottom rail, and a movable finger 178 that is slidable toward and away from the fixed finger 176 by manual manipulation with the movable finger also projecting forwardly through the front wall of the bottom rail. As will be appreciated hereafter, the movable finger is biased to the left, which is its neutral position, wherein the lock 162 grips the guide cords but the bias can be overcome by sliding the movable finger to the right as shown in FIG. 16 and to be discussed in more detail hereafter which releases the grip of the lock on the guide cords allowing the guide cords to slide freely through the lock.

Figure 20:
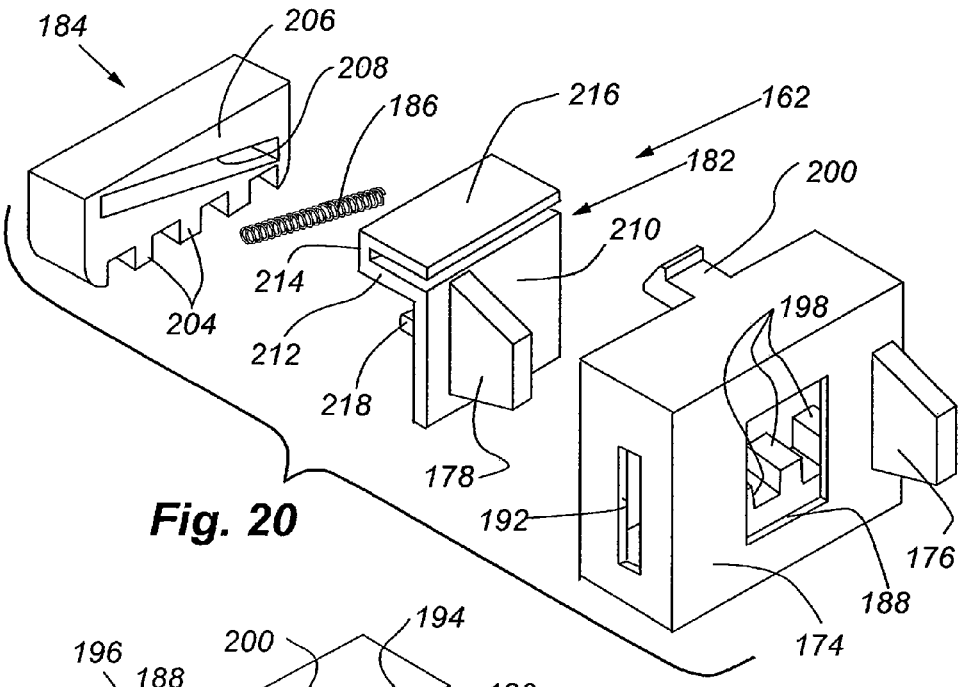
FIG. 20 is a front exploded isometric of the lock shown in FIGS. 15-19.
Figure 21:
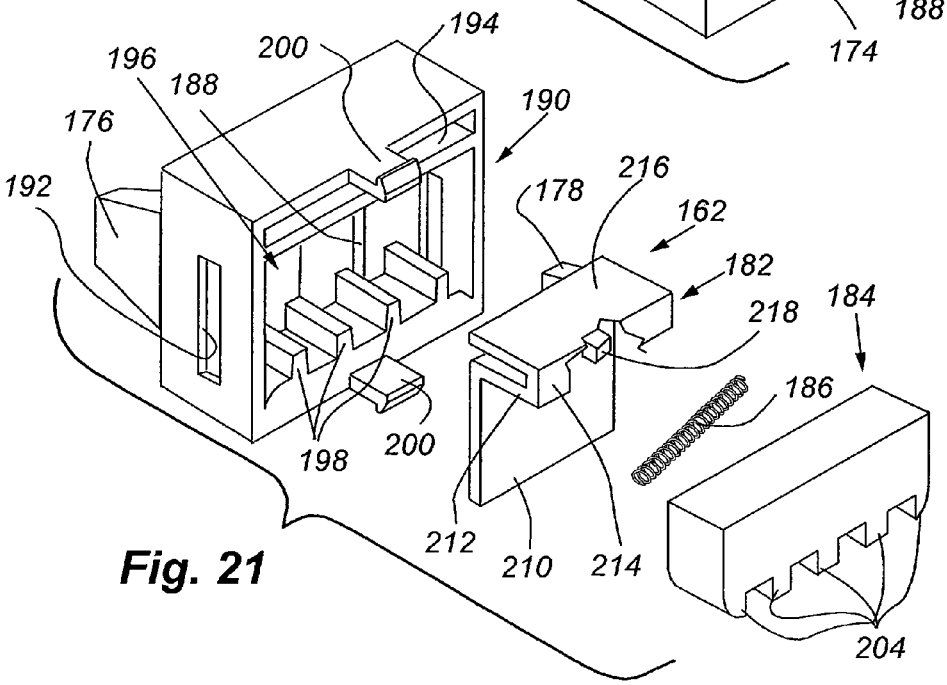
FIG. 21 is a rear exploded isometric similar to FIG. 20.
Figure 22:
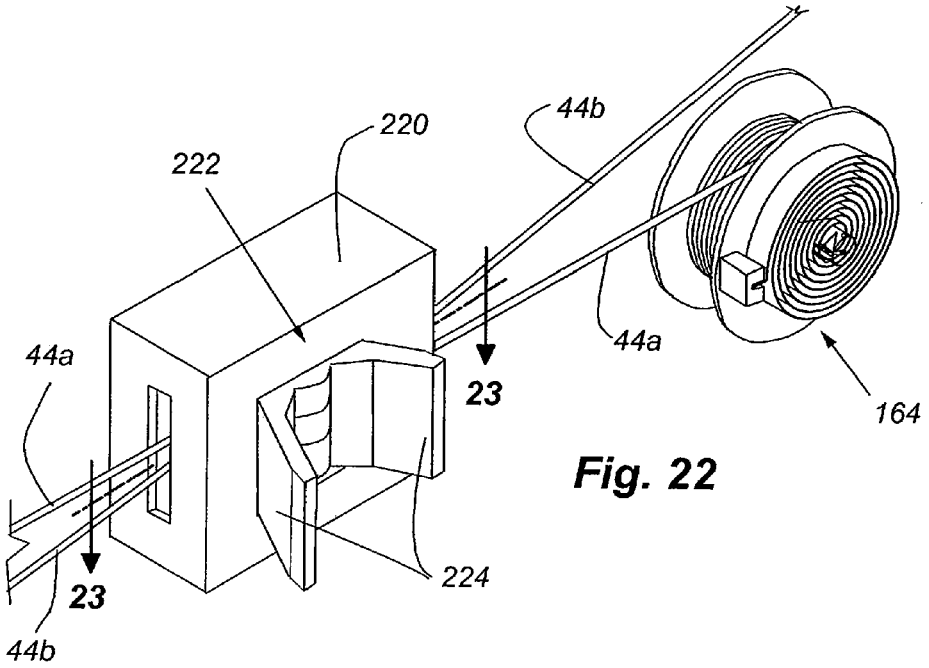
FIG. 22 is an isometric of an alternative embodiment to that shown in FIG. 15 in a neutral locked position.

Referring to FIGS. 20 and 21, which are both exploded isometrics of the slide lock 162, FIG. 20 looking at the front of the slide lock and FIG. 22 at the rear, it will be seen that the slide lock includes four component parts. The housing 170 that has a hollow interior and is snap locked onto the rear wall of the bottom rail as mentioned previously, a finger slide member 182 that is movable laterally of the housing, a vertically movable block 184, and a compression spring 186 for biasing the laterally movable slide member to the left as viewed in FIG. 20.

The housing 170 can be seen to have the outer face or front wall 174 with an opening 188 therethrough and with the fixed finger 176 projecting forwardly therefrom, an open rear 190, and vertical slots 192 in the left and right side walls thereof. Formed across the top of the interior of the housing is an upper horizontal slot 194 extending from left to right of the housing for guiding movement of the slide member 182 as will be described hereafter. Beneath the slot 194 is a large cavity 196 having a plurality of upwardly projecting fixed fingers 198 extending from the front to the rear of the housing with the fingers defining channels therebetween. Projecting off the rear of the housing are catch fingers 200 at the top and bottom of the housing which are alignable with corresponding slots 202 (FIG. 19) in the rear wall of the bottom rail 36 so that the housing can be releasably snapped to the bottom rail at a desired location.

Figure 17:
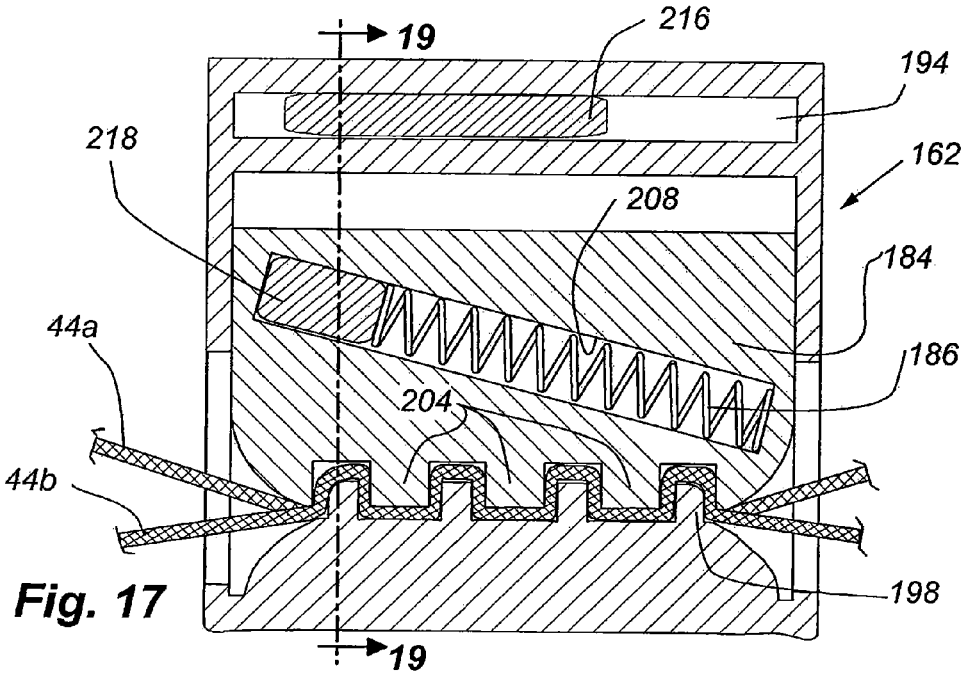
FIG. 17 is an enlarged section taken along line 17-17 of FIG. 15.
Figure 18:
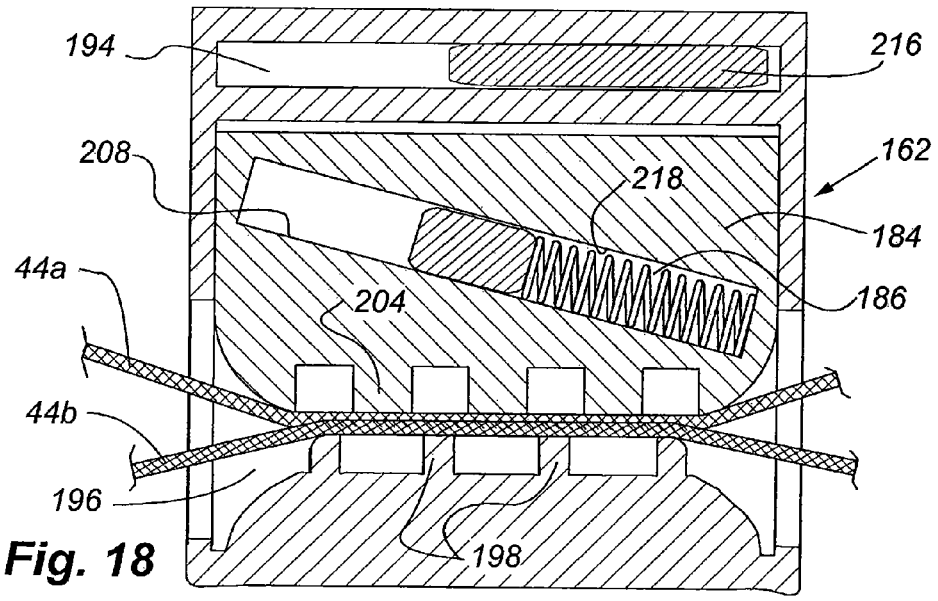
FIG. 18 is an enlarged section taken along line 18-18 of FIG. 16.

The vertically movable block 184 has its width corresponding to the width of the cavity 196 in the housing 170, but a height that is less than the height of the cavity in the housing. The vertically movable block is therefore able to slide up and down within the cavity of the housing. The block 184 has a plurality of downwardly projecting fingers 204 extending from front to back defining channels therebetween with the fingers being offset from the fingers 198 in the housing so as to interdigitate with the fingers in the housing when they are moved into adjacent relationship. The front face 206 of the vertically movable block, as best seen in FIGS. 17, 18 and 20, has a groove 208 formed therein which is inclined relative to horizontal so as to be higher at its left end and lower at its right end as viewed in FIG. 20.

Figure 19:
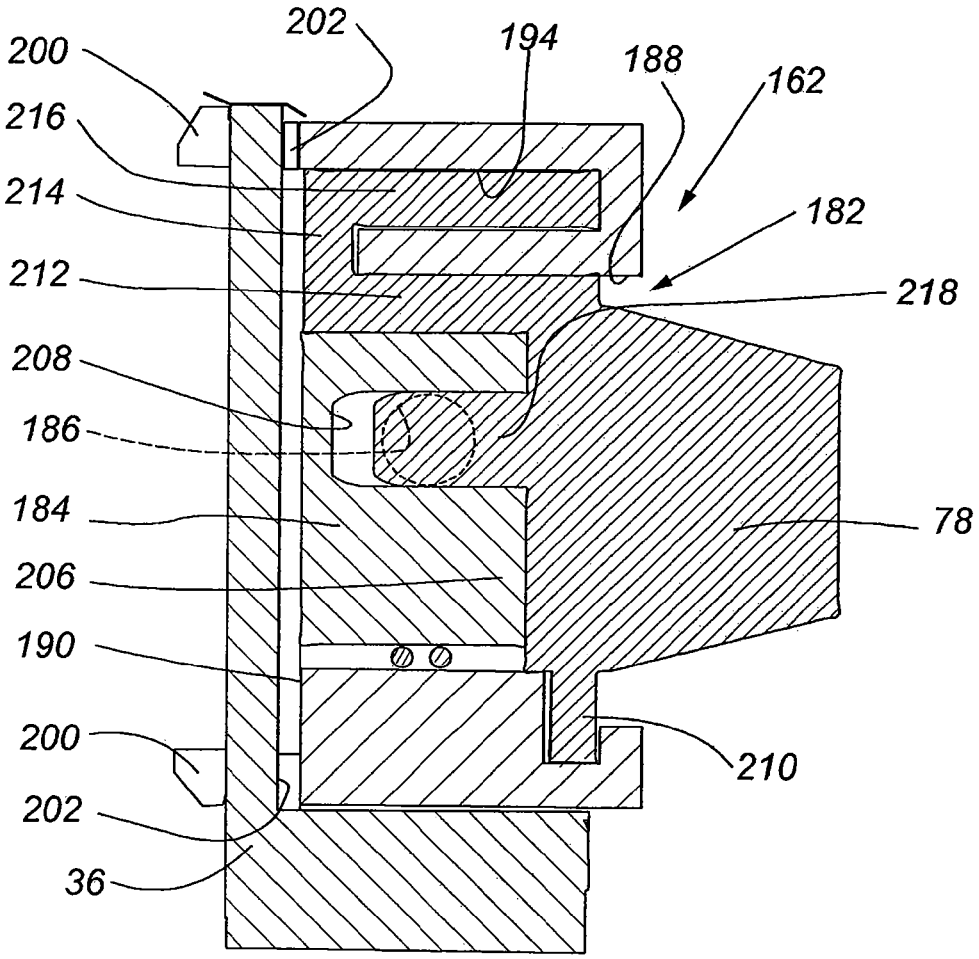
FIG. 19 is a section taken along line 19-19 of FIG. 17.

The finger slide member 182 has a vertical plate 210, a rearwardly projecting first upper horizontal plate 212, a rear wall 214, and a forwardly projecting second upper horizontal plate 216 with the forwardly projecting horizontal plate adapted to be slidably received in the slot 194 of the housing, as possibly best appreciated by reference to FIG. 19. This slidably supports the finger slide within the housing so that it can be slid transversely of the housing in the direction of the length of the bottom rail without moving up or down. Projecting forwardly from the vertical plate of the slide member is a follower tab or bar 218 adapted to be slidably received in the inclined slot 194 of the vertically movable block. As will be best appreciated by reference to FIGS. 17 and 18, as the follower tab 218 is slid along the length of the inclined slot as the slide member is slid from side to side within the housing, the vertically movable block is forced by the tab to move up or down between a neutral interdigitating position, as seen in FIG. 17, and a released position, as seen in FIG. 18. The compression spring 186 is positioned within the inclined slot as seen in FIGS. 17 and 18 so as to bias the follower block toward the higher end of the inclined slot, which is toward the neutral position of the lock with the movable finger 178 being maximally spaced from the fixed finger 176. This is possibly best appreciated by reference to FIGS. 15 and 16 with FIG. 15 showing the lock in a neutral position and FIG. 16 in an activated unlocked position. As also appreciated by reference to FIG. 17, when the lock is in its neutral activated position, as seen in FIG. 17, the guide cords 44*a* and 44*b* are gripped by the interdigitated fingers so that the cords cannot slide through the lock. However, by retracting or moving the vertically movable block upwardly, the cords are free to slide through a gap or space between the block and the fixed bottom of the housing as seen in FIG. 18.

The middle rail 42, as mentioned previously, has an identical lock 162 and the cords 44*a* and 44*b* extend therethrough as seen in FIG. 6 so that movement of the middle rail relative to the headrail 34 is accomplished in the same way by sliding the movable finger 178 to the right against the bias of the coil spring 186 and moving the rail up or down until it is desirably positioned whereupon the finger slide is released so that the manual lock again grips the cords and retains the middle rail in a fixed position.

Figure 23:
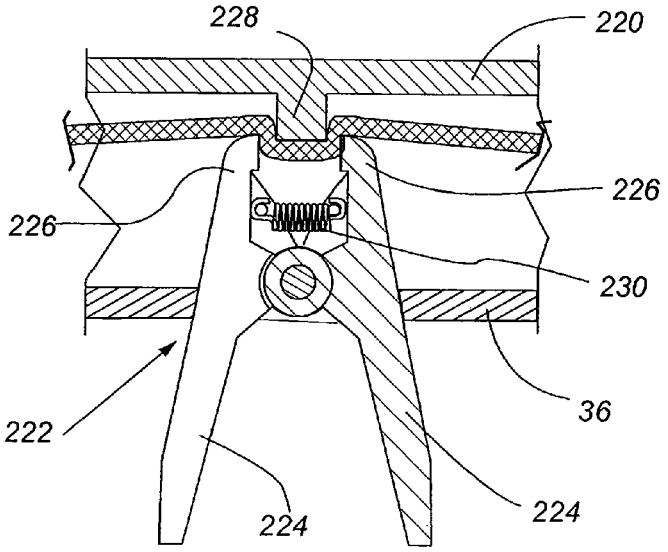
FIG. 23 is a section taken along line 23-23 of FIG. 22.

A third embodiment of the present disclosure is shown in FIGS. 22 and 23. In this embodiment, the cords 44*a* and 44*b* again extend transversely through a housing 220 and pivotally mounted within the housing is a clothesline type clamp 222 having two manually engageable arms 224 which when moved toward each other release the opposite ends 226 of the arms from a gripping relationship as shown in FIG. 20 where the cords are pinched on a transverse rib 228 of the housing. A coil spring 230 connecting the arms of the clothesline type clip bias the arms toward the gripping position of FIG. 20 with a squeezing of the arms releasing the gripping position.

It should be appreciated the various embodiments of the manually operable locks can be interchanged in pairs or independently so that the locks in the bottom and middle rails may or may not match.

As mentioned previously, while the lock system of the present disclosure can be used with top down/bottom up coverings by placing releasable manually operable locks in both the bottom rail and the middle rail, the principles of the disclosure are also applicable in a bottom up covering where there is no middle rail but only a movable bottom rail 36, as shown for example in FIG. 7. FIG. 7 shows a headrail 34 with first and second guide cords 44*a* and 44*b*, a shade material 38, and the bottom rail 36, with the bottom rail including the lock system 46 shown in FIGS. 5, 7, and 8, but as mentioned, the lock system 162 of FIGS. 6 and 15-21 might also be used where take-up coil springs are used rather than the transversely extending rotatable shaft.

Although the present disclosure has been described with a certain degree of particularity, it is understood the disclosure has been made by way of example, and changes in detail or structure may be made without departing from the spirit of the disclosure as defined in the appended claims.

What is claimed is:

1. A covering for an architectural opening comprising:

a shade material;

a first rail operably connected to the shade material and movable between a retracted position and an extended position;

a second rail operably connected to the shade material opposite the first rail and movable between a retracted position and an extended position independently of the first rail;

a first operating cord and a second operating cord each operably connected to the first rail and the second rail;

a first lock member at least partially received within the first rail and configured to selectively permit movement of the first rail;

a second lock member at least partially received within the second rail and configured to selectively permit movement of the second rail; and a cord take up system operably connected to the first rail including at least one spool and a drive shaft operably connected to the at least one spool; wherein as the first rail moves towards the retracted position the drive shaft rotates and the first operating cord and the second operating cord wrap around the at least one spool.

2. The covering of claim 1, wherein the first lock member further includes a housing including at least two housing fingers;

a movable block at least partially received within the housing, the movable block including at least two engaging fingers; wherein a portion of the first operating cord is positioned between the at least two housing fingers and the at least two engaging fingers, and in an engaged position the at least two housing fingers interlock with the at least two engaging fingers to substantially prevent the first operating cord from moving therebetween.

3. The covering of claim 2, wherein the first lock member further includes a slider member slidably connected to the housing and operably connected to the movable block, and the movable block moves as the slider member slides along a length of the housing.

4. The covering of claim 1, further comprising a headrail, wherein the second rail is positioned between the headrail and the first rail; and the second rail and the first rail are movable toward and away from the headrail independently of each other.

5. The covering of claim 4, wherein the first and second operating cords crisscross between the headrail and the first rail along the length of and through the second rail.

6. The covering of claim 1, wherein the first lock member is slidable along at least a portion of a length of the first rail.

7. The covering of claim 6, wherein the first lock member further includes a slide member slidable along a length of the first rail; and an engagement member configured to selectively engage the drive shaft; wherein in an engaged position the engagement member substantially prevents the drive shaft from rotating; and in a disengaged position the engagement member permits the drive shaft to rotate.

8. The covering of claim 7, wherein the first lock member further includes an actuating member extending from the slide member that is at least partially exposed through an aperture defined within the first rail.

9. The covering of claim 6, wherein the first lock member further includes a slider member, wherein in a first position of the slider member at least one of the first operating cord or the second operating cord is substantially prevented from moving and in a second position of the slider member the at least one of the first operating cord or the second operating cord is permitted to move.

10. The covering of claim 9, wherein the first lock member further includes an engagement member, and in the first position of the slider member the engagement member is engaged with the at least one of the first operating cord or the second operating cord, and in the second position of the slider member the engagement member is disengaged with the at least one of the first operating cord or the second operating cord.

11. The covering of claim 9, wherein the slider member is a manually actuatable member.

12. A covering for an architectural opening comprising:

a headrail;

a collapsible shade material suspended from the headrail;

a middle rail operably connected along a top edge of the shade material and movable toward and away from the headrail;

a bottom rail operably connected along a bottom edge of the shade material, and movable toward and away from the headrail independently of the middle rail to collapse and uncollapse the shade material positioned between the middle rail and the bottom rail;

a pair of flexible control elements extending operatively between the headrail and the bottom rail, the middle rail and the bottom rail being operatively connected to the flexible control elements;

a first manually operable lock member operatively associated with the flexible control elements to permit selective releasable positioning of the bottom rail;

a second manually operable lock member operatively associated with the flexible control elements to permit selective releasable positioning of the middle rail; and a biased flexible element take-up system in the bottom rail biased to gather and release the flexible control elements as the bottom rail is moved toward and away from the headrail.

13. The covering of claim 12, wherein the take-up system includes a pair of individual spring biased take-up spools, wherein each of the pair of spools is associated with a respective one of the flexible control elements.

14. The covering of claim 12, wherein the take-up system includes a rotatable shaft about which each flexible element can be wound and unwound as the bottom rail is moved toward and away from the headrail, the lock member being selectively engageable with the shaft to permit or restrict rotation of the shaft whereby the bottom rail can be selectively and manually moved and retained in a selected position.

15. The covering of claim 12, wherein at least one of the first and second lock members includes a biased push button.

16. The covering of claim 12, wherein at least one of the first and second lock members includes a slider member.

17. The covering of claim 12, wherein the flexible control elements pass through the first lock member and the first lock member is adapted to selectively secure and release the flexible control elements.

18. The covering of claim 17, wherein the flexible control elements pass through the second lock member and the second lock member is adapted to secure and release the flexible control elements.

19. The covering of claim 18, wherein the second lock member includes an actuator biased to a locked position.

20. The covering of claim 18, wherein the second lock member includes a slider member.

21. A shade comprising:

a top rail;

a bottom rail operably connected to the top rail and movable away from and towards the top rail;

a middle rail operably connected to the top rail between the top rail and the bottom rail, the middle rail movable away from and towards the top rail independently of the bottom rail;

a shade material operably connected to and between the bottom rail and the middle rail;

a pair of cords extending between the top rail and the bottom rail; and a take-up system at least partially received in the bottom rail, the take-up system biased to gather and release the cords as the bottom rail is moved toward and away from the top rail, wherein the bottom rail includes a first manually operable lock member operatively associated with the cords; and the middle rail includes a second manually operable lock member operatively associated with the cords.

22. The shade of claim 21, wherein the take-up system includes a drive shaft rotatably supported within the bottom rail;

a first spool rotatably connected to a first end of the drive shaft and operably associated with a first cord of the pair of cords; and a second spool rotatably connected to a second end of the drive shaft and operably associated with a second cord of the pair cords; wherein as the drive shaft rotates in a first direction, the first cord wraps around the first spool and the second cord wraps around the second spool; and as the drive shaft rotates in a second direction the first cord unwraps from around the first spool and the second cord unwraps from around the second spool.

23. The shade of claim 21, wherein the middle rail and the bottom rail each move the shade material between a retracted position and an extended position.

* * * * *